US009677751B2

(12) United States Patent
Winters et al.

(10) Patent No.: US 9,677,751 B2
(45) Date of Patent: Jun. 13, 2017

(54) MULTI-FUNCTIONAL HEAT SINK

(71) Applicants: Philip Dean Winters, Senoia, GA (US); Christopher Ladewig, Fayetteville, GA (US)

(72) Inventors: Philip Dean Winters, Senoia, GA (US); Christopher Ladewig, Fayetteville, GA (US)

(73) Assignee: Cooper Technologies Company, Houston, TX (US)

( * ) Notice: Subject to any disclaimer, the term of this patent is extended or adjusted under 35 U.S.C. 154(b) by 139 days.

(21) Appl. No.: 14/470,824

(22) Filed: Aug. 27, 2014

(65) Prior Publication Data

US 2015/0062911 A1 Mar. 5, 2015

Related U.S. Application Data

(60) Provisional application No. 61/870,673, filed on Aug. 27, 2013.

(51) Int. Cl.

| | |
|---|---|
| ***F21S 8/00*** | (2006.01) |
| ***F21S 13/10*** | (2006.01) |
| ***F21V 29/502*** | (2015.01) |
| ***F21V 11/16*** | (2006.01) |
| ***F21V 29/89*** | (2015.01) |
| *F21W 131/103* | (2006.01) |
| *F21Y 101/00* | (2016.01) |

(52) U.S. Cl.

CPC ..... *F21V 29/502* (2015.01); *F21V 11/16* (2013.01); *F21V 29/89* (2015.01); *F21W 2131/103* (2013.01); *F21Y 2101/00* (2013.01)

(58) Field of Classification Search

CPC ..... F21V 11/16; F21V 29/502; F21V 29/89; F21W 2131/103

USPC ..... 362/249.02, 311.02, 373–375, 431

See application file for complete search history.

(56) References Cited

U.S. PATENT DOCUMENTS

| | | | | |
|---|---|---|---|---|
| 7,789,528 | B2 | 9/2010 | Mo et al. | |
| 9,212,812 | B2 * | 12/2015 | Kinnune | F21V 29/505 |
| 2011/0222284 | A1 | 9/2011 | Kong | |
| 2011/0235335 | A1 * | 9/2011 | Ishida | F21S 8/086 362/296.01 |
| 2012/0147608 | A1 | 6/2012 | Kawagoe | |
| 2012/0275162 | A1 | 11/2012 | Spiro | |
| 2014/0177226 | A1 | 6/2014 | Goelz | |

FOREIGN PATENT DOCUMENTS

| | | |
|---|---|---|
| KR | 1020110138485 | 12/2011 |
| RU | 106335 | 7/2011 |
| RU | 111254 | 12/2011 |
| RU | 2470222 | 12/2012 |

OTHER PUBLICATIONS

International Search Report, mailed Nov. 13, 2014, for PCT/US2014/052996.

* cited by examiner

*Primary Examiner* — Jason Moon Han
(74) *Attorney, Agent, or Firm* — King & Spalding LLP

(57) ABSTRACT

A multi-functional heat sink includes a top portion and a skirt portion extending down from the top portion. When a light source is attached to the top portion on an underside of the multi-functional heat sink, the skirt portion reduces risk of rain water from reaching the light source and prevents light emitted by the light source from exiting the multi-functional heat sink in an upward direction. The multi-functional heat sink is made from sheet metal.

8 Claims, 14 Drawing Sheets

MULTI-FUNCTIONAL HEAT SINK

CROSS REFERENCE TO RELATED APPLICATIONS

The present application claims priority to under 35 U.S.C. §119(e) and incorporates herein by reference U.S. Provisional Patent Application No. 61/870,673, titled "Multi-Functional Heat Sink," and having a filing date of Aug. 27, 2013.

TECHNICAL FIELD

The present disclosure relates generally to outdoor lighting solutions, and more particularly to a multi-functional heat sink for an outdoor lighting fixture.

BACKGROUND

Some outdoor lighting fixtures, such as some roadway lighting fixtures, often need to include a heat sink to dissipate heat from light sources and other electrical components of the light fixtures. In order to have a heat sink with adequate surface area to dissipate heat from light sources of an outdoor lighting fixture, heat sinks used in outdoor lighting fixtures are generally made by extrusion or die casting. For example, outdoor light fixture heat sinks often have protruding structures such as fins that are designed to increase the surface area of the heat sinks. However, as light sources, such as light emitting diodes, become more efficient, required heat sink surface area has generally decreased.

Outdoor light fixtures are also typically exposed to various weather conditions such as rain that can damage electronic components including the light sources. Further, reduction of sky-glow and glare caused by outdoor lighting fixtures is desirable. For example, sky-glow is typically caused by artificial light sources (such as outdoor lighting fixtures) and can produce a luminous haze that can, for example, limit visibility of the stars.

Thus, a structure of an outdoor lighting fixture that cost effectively provides an adequate heat sink and further functions to reduce water damage to the lighting fixture while resulting in reduced sky glow and glare is desirable.

SUMMARY

In general, the present disclosure relates to outdoor lighting solutions, and more particularly to a multi-functional heat sink for an outdoor lighting fixture. In an example embodiment, a multi-functional heat sink includes a top portion and a skirt portion extending down from the top portion. When a light source is attached to the top portion on an underside of the multi-functional heat sink, the skirt portion reduces risk of rain water from reaching the light source and prevents light emitted by the light source from exiting the multi-functional heat sink in an upward direction. The multi-functional heat sink is made from sheet metal.

In another example embodiment, an outdoor lighting fixture further includes a housing having a front section and a back section. The outdoor lighting fixture further includes a light source and a multi-functional heat sink that is made from sheet metal. The multi-functional heat sink includes a top portion. The housing is attached to the top portion. The front section of the housing is positioned on a top side of the multi-functional heat sink and covers a first section of the top portion. A second section of the top portion is outside of the housing. The light source is attached to the top portion at the first section of the top portion on the underside of the multi-functional heat sink. The multi-functional heat sink further includes a skirt portion extending down from the top portion. The skirt portion reduces risk of rain water reaching the light source and prevents light emitted by the light source from exiting the lighting fixture in an upward direction relative to a lower edge of the skirt portion.

In another example embodiment, an outdoor lighting fixture includes a housing and a heat sink. The heat sink is made from sheet metal. The heat sink is rotatably attached to the housing. The housing is disposed on a top side of the heat sink. A first section of the heat sink is covered by the housing. A second section of the heat sink is exposed outside of the housing. The outdoor lighting fixture further includes a light source attached to the heat sink on an underside of the heat sink. The light source is positioned at the second section of the heat sink.

These and other aspects, objects, features, and embodiments will be apparent from the following description and the claims.

BRIEF DESCRIPTION OF THE FIGURES

Reference will now be made to the accompanying drawings, which are not necessarily drawn to scale, and wherein.

Figure 1:
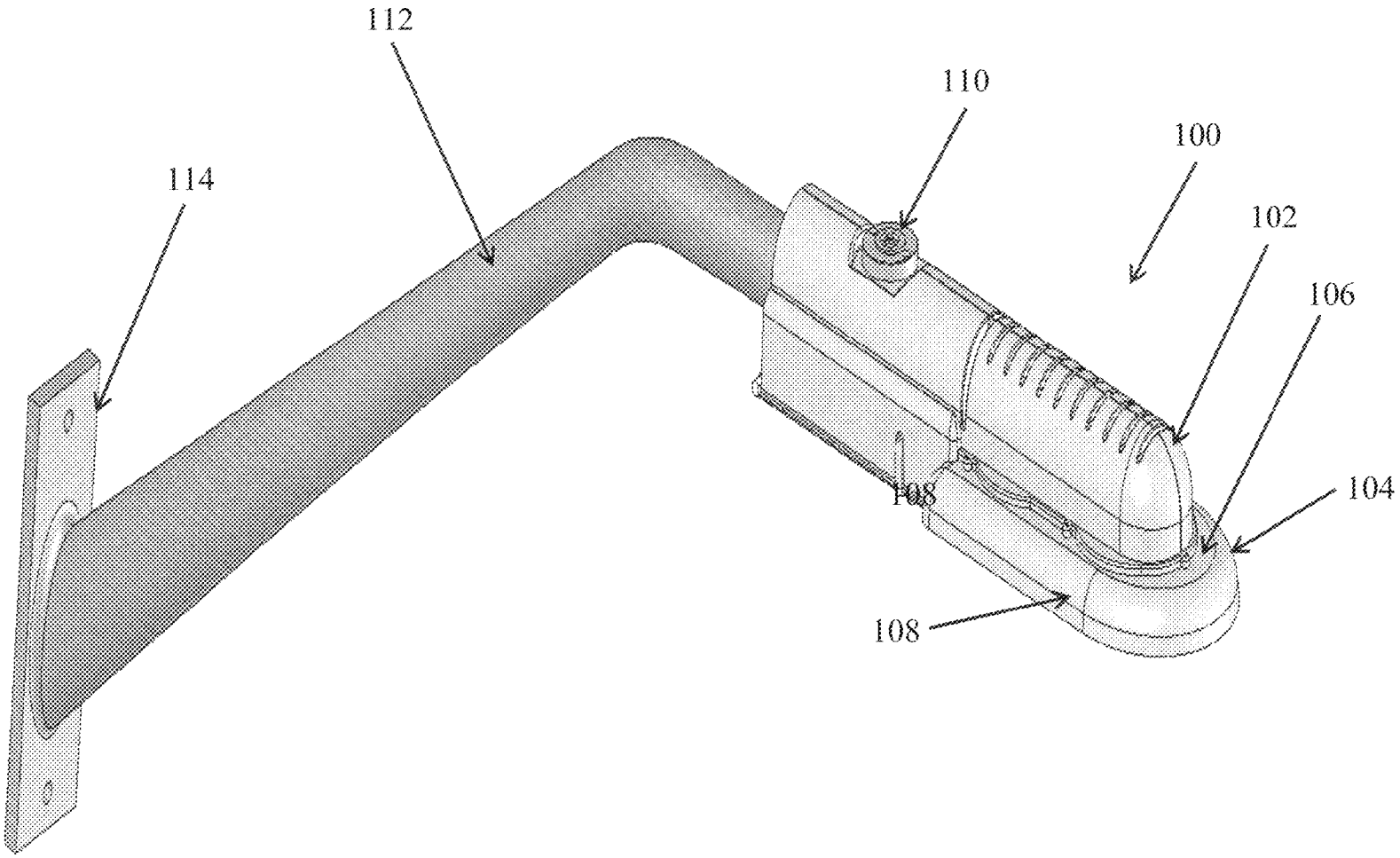
FIG. 1 illustrates an outdoor lighting fixture including a multi-functional heat sink according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, reference numerals designate like or corresponding, but not necessarily identical, elements.

DETAILED DESCRIPTION OF THE EXAMPLE EMBODIMENTS

In the following paragraphs, example embodiments will be described in further detail with reference to the figures. In the description, well known components, methods, and/or processing techniques are omitted or briefly described. Furthermore, reference to various feature(s) of the embodiments is not to suggest that all embodiments must include the referenced feature(s).

Turning now to the figures, particular embodiments are described. FIG. 1 illustrates an outdoor lighting fixture including a multi-functional heat sink. The lighting fixture 100 includes a housing 102 and a multi-functional heat sink 104. In some example embodiments, the lighting fixture 100 may be attached to a first end of a support beam 112 that includes an attachment plate 114 at a second end of the support beam 112. The lighting fixture 100 also includes an optional sensor 110 that is positioned on the housing 102. For example, the sensor 110 may be a light sensor that senses the presence of adequate light and provides a corresponding indication. The light sources of the lighting fixture 100 may be turned on or off based on the indication from the sensor 110.

The multi-functional heat sink 104 is attached to a bottom portion of the housing 102. For example, the multi-functional heat sink 104 may be removably or rotatably attached to the housing 102. In some example embodiments, the multi-functional heat sink 104 has a planar portion 106 and a skirt portion 108. The skirt portion 108 extends down from the planar portion 106. For example, the skirt portion 108 may extend down from the outer perimeter of the planar portion 106 on all sides of the multi-functional heat sink 104.

Figure 2:
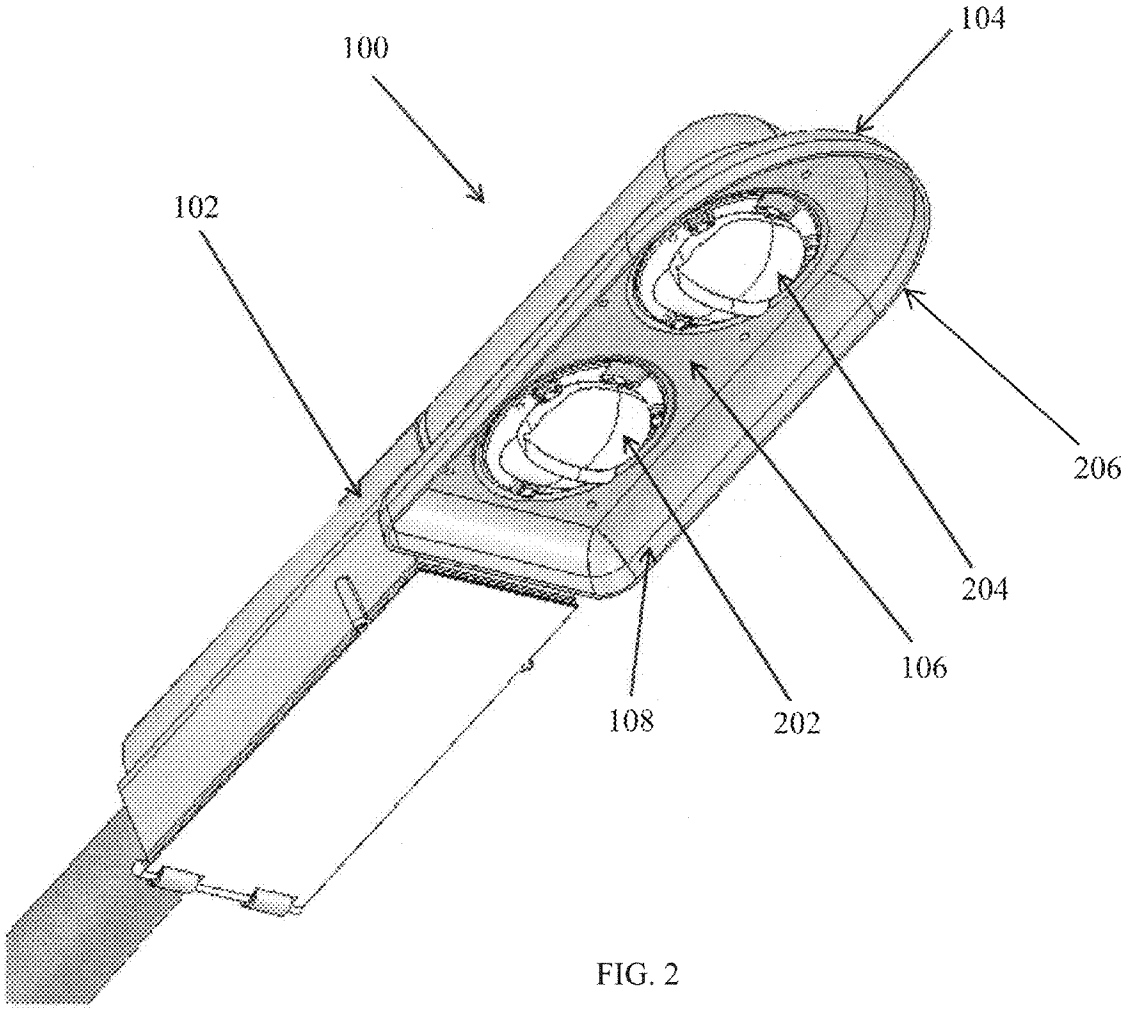
FIG. 2 illustrates a bottom view of the lighting fixture of FIG. 1 according to an example embodiment.
Figure 3:
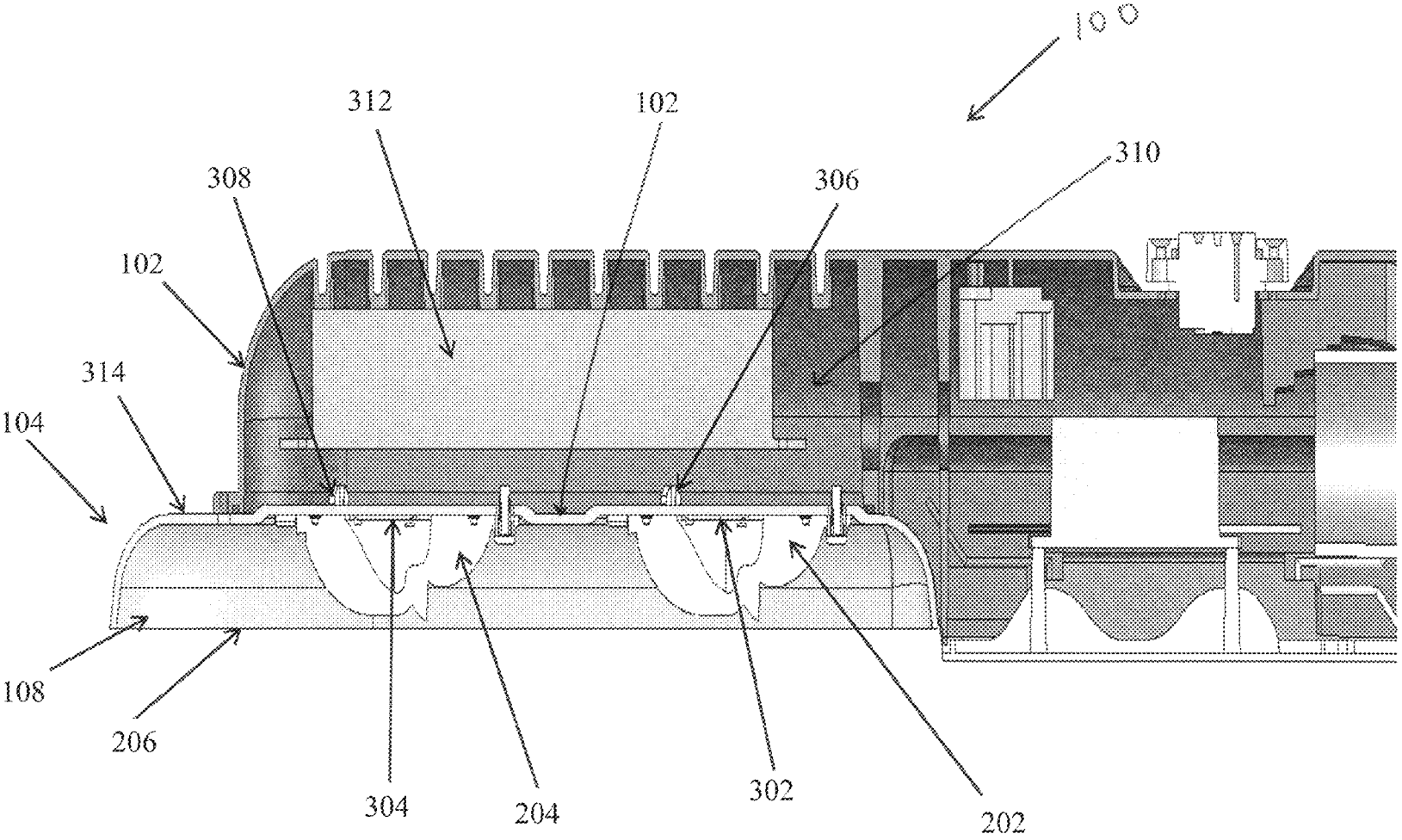
FIG. 3 illustrates a cross-sectional view of the lighting fixture of FIG. 1 according to an example embodiment.

The multi-functional heat sink 104 is designed to dissipate heat from light sources and other electrical components of the lighting fixture 100. As illustrated in FIGS. 2 and 3, the lighting fixture 100 includes light sources (e.g., light emitting diodes (LEDs)) that are attached to the multi-functional heat sink 104. For example, the light sources may be disposed on a printed circuit board (PCB) that is coupled to an inside surface of the multi-functional heat sink 104. The multi-functional heat sink 104 may be made from sheet metal, such as aluminum sheet metal, that is an effective heat conductor. Heat generated, for example, by the light sources may be transferred to the multi-functional heat sink 104 from the light sources and effectively dissipated by the multi-functional heat sink 104. Further, because the skirt 108 and sections of the planar portion 106 of the multi-functional heat sink 104 are exposed to outside air, heat from the light sources and from other electrical components of the lighting fixture 100 may be effectively dissipated by the multi-functional heat sink 104 into the surrounding environment.

As better illustrated in FIGS. 2 and 3, the multi-functional heat sink 104 also functions to protect the light sources from water such as rain water. To illustrate, because the skirt portion 108 extends to a plane below the light sources and the lenses, the skirt portion 108 helps to prevent rain water (e.g., rain falling at slanted angles) from reaching the light sources and the lenses. Further, because the light sources are attached to the inside surface of the planar portion 106 of the multi-functional heat sink 104, the planar portion 106 also provides protection against the rain. In addition, a significant section of the planar portion 106 of the multi-functional heat sink 104 is covered by the housing 102. Because the skirt portion 108 curves down from the outer perimeter of the planar portion 106, water that accumulates on the exposed sections of the planar portion 106 is provided a convenient path to the ground via the skirt portion 108.

As described below with respect to FIGS. 2 and 3, the multi-functional heat sink 104 further functions as an optical cutoff to reduce sky-glow and glare that may otherwise result from light emitted by the light source of the lighting fixture 100. Further, as described below with respect to FIGS. 3 and 4, the multi-functional heat sink 104 further functions as a service door to enable access to a compartment of the housing 102 that is above the multi-functional heat sink 104. Because the multi-functional heat sink 104 can be made from a single piece of sheet metal, the multi-functional heat sink 104 can be cost effectively manufactured to function as a heat sink, a watershed, an optical cutoff, and a service door. Further, because of improved efficiency of light sources such as LEDs, the multi-functional heat sink 104 can be made from sheet metal without requiring protrusions, such as fins, or other structures used in traditional die cast or extruded heat sinks. For example, the multi-functional heat sink 104 can be made from aluminum sheet metal (e.g., heavy gauge aluminum sheet metal), which has the benefit of being less expensive and more thermally conductive than die-cast or extruded aluminum.

FIG. 2 illustrates a bottom view of the outdoor lighting fixture 100 of FIG. 1 according to an example embodiment. As illustrated, the lighting fixture 100 includes the housing 102 and multi-functional heat sink 104. The multi-functional heat sink 104 is removably or rotatably attached to the housing 102. For example, the multi-functional heat sink 104 may be removably attached to the housing 102 using one or more fasteners. The multi-functional heat sink 104 may also be rotatably attached to the housing 108, for example, using one or more hinges.

In some example embodiments, the lighting fixture 100 also includes a first lens 202 and a second lens 204. The first lens 202 and the second lens 204 are attached to the planar portion 106 of the multi-functional heat sink 104. The first lens 202 covers one or more light sources (e.g., one or more light emitting diodes (LEDs)) that are attached to the inside surface of the planar portion 106. Similarly, the second lens 204 covers one or more light sources that are attached to the inside surface of the planar portion 106. As described above, the multi-functional heat sink 104 dissipates heat from the light sources.

The multi-functional heat sink 104 further functions as a watershed that protects the light sources and related electrical components from water, such as rain water, that may cause damage (for example, due to a short circuit) to the lighting fixture 100. To illustrate, when the lighting fixture 100 is positioned parallel to a horizontal surface, the skirt portion 108, which extends down from the planar portion 106, reaches to a plane below the lenses 202 and 204. Thus, the planar portion 106 and the skirt portion 108 substantially prevent rain water (even from slanted rain) from directly reaching the lenses 202 and 204. Further, water that accumulates on exposed sections of the planar portion 106 can conveniently roll down the curved surface of the skirt portion 108 toward the ground.

The multi-functional heat sink 104 further functions as an optical cutoff to reduce sky-glow and glare that may result from light emitted by light sources of the lighting fixture 100. To illustrate, because the lenses 202 and 204 cover respective light sources, light from the light sources is emitted through the lenses 202 and 204. For example, to reduce sky-glow and glare, the lighting fixture 100 may be positioned such that a lower edge 206 of the skirt portion 108 is below the first lens 202 and the second lens 204 on all sides of the lighting fixture 100. Thus, light emitted by the light sources of the lighting fixture 100 exits from under the multi-functional heat sink 104 in directions that are below an imaginary horizontal plane that includes the lower edge 206 of the skirt portion 108. By limiting the exit path of the light emitted by the light sources to be below the lower edge 206, sky-glow and glare from the lighting fixture 100 are reduced.

FIG. 3 illustrates a cross-sectional view of the lighting fixture of FIG. 1 according to an example embodiment. As illustrated in FIG. 3, a first light source (e.g., an LED) 302 and a second light source (e.g., an LED) 904 are attached to the planar portion 106 of the multi-functional heat sink 104. For example, the first light source 302 may be disposed on a PCB that is attached to the planar portion 106. Similarly, the second light source 304 may be disposed on another PCB that is attached to the planar portion 106. While the light sources 302 and 304 attached to sections of the planar portion 106 are shown as elevated above other sections of the planar portion 106, in alternative embodiments (for example, as shown in the example embodiment of FIG. 4), all sections of the planar portion 106 are substantially at the same level.

As illustrated in FIG. 3, the first lens 202 is positioned over the first light source 302, and the second lens 204 is positioned over the second light source 304. Light emitted by the first light source 302 passes through the first lens 202. Similarly, light emitted by the second light source passes through the second lens 204. The first lens 202 may be attached to the planar portion 106 of the multi-functional heat sink 104 using one or more fasteners (e.g., snaps) 306 that extend through one or more corresponding fastener holes in the planar portion 106. Similarly, the second lens 204 may be attached to the planar portion 106 of the multi-functional heat sink 104 using one or more fasteners 308 that extend through one or more corresponding fastener holes in the planar portion 106.

In some example embodiments, the housing 102 may include a compartment 310 that is positioned above the multi-functional heat sink 104. A driver (e.g., an LED driver) 312 may be positioned within the compartment 310. The driver 312 is designed to provide power to the light sources 302 and 304. For example, wires coupled to the driver 312 may be extended to the light sources 302, 304 through the wire holes in a section the planar portion 106 that is covered by the housing 106. Heat from the driver 312 may be transferred to the housing 102 via contact points between the driver 312 and the housing 102. Further, some of the heat from the driver 312 may be transferred to the planar portion 106 to be dissipated by the multi-functional heat sink 104.

As illustrated in FIG. 3 as well as FIG. 1, the sections of the planar portion 106 are covered by the housing 102 while other sections, such as exposed section 314 of the planar portion 106, are outside the housing 102. Further, the skirt portion 108 is outside of the housing 102. As described above, the multi-functional heat sink 104 can be made from sheet metal, such as aluminum sheet metal, that is an effective heat conductor. Thus, the exposed section 314 and the skirt portion 108 effectively dissipate heat transferred to the multi-functional heat sink 104 from the light sources 302, 304 and heat transferred to the multi-functional heat sink 104 from driver 312.

Further, as clearly illustrated in FIG. 3, the lighting fixture 100 may be positioned such that the lower edge 206 of the skirt portion 108 is below the lenses 202 and 204. Because the light sources 302, 304 are positioned in the inside surface of the planar portion 106 surrounded on multiple sides by the skirt portion 108, the multi-functional heat sink 104 functions as a watershed to reduce risk of water damage to the lighting fixture 100, for example, due to electrical short circuiting. Further, because the lower edge 206 of the skirt portion 108 is below the lenses 202 and 204, light from the light sources 302 and 304 is prevented from exiting the lighting fixture 100 above the lower edge 206. Thus, the multi-functional heat sink 104 also functions as an optical cutoff that reduces sky-glow and glare from the light sources 302, 304 of the lighting fixture 100.

Figure 4:
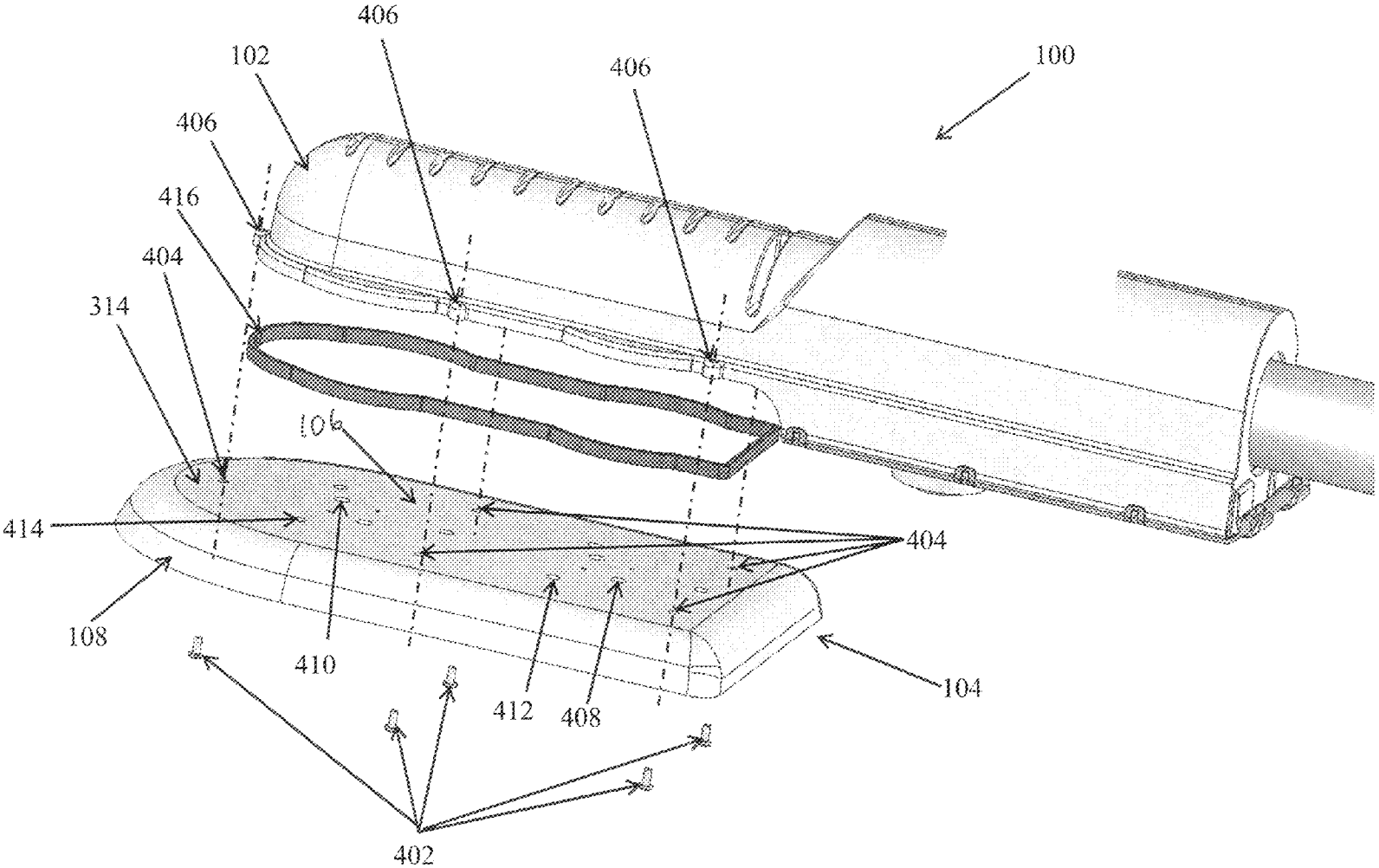
FIG. 4 illustrates a partially-exploded view of the lighting fixture of FIG. 1 according to an example embodiment.

FIG. 4 illustrates another partially-exploded view of the lighting fixture of FIG. 1 according to an example embodiment. As illustrated in FIG. 3, in some example embodiments, the multi-functional heat sink 104 may be removably attached to the housing 102 using fasteners 402 (e.g., screws). For example, the fasteners 402 may be inserted through corresponding fastener holes 404 in the multi-functional heat sink 104 and attach to corresponding attachment holes 406 in the housing 102. Alternatively or in addition, the multi-functional heat sink 104 may be rotatably attached to the housing using one or more hinges attached, for example, to a section (e.g., rear section) of the skirt portion 108. Because the multi-functional heat sink 104 is removable, the multi-functional heat sink 104 functions as a service door to provide access to components, such as the driver 312.

In some example embodiments, wires from a driver (e.g., the driver 312 of FIG. 3) may be extended through one or more wire holes 408, 410 to be coupled to the light sources 302 and 304, respectively, of FIG. 3. Fasteners (e.g., fasteners 306, 308 of FIG. 3) may be inserted in corresponding fastener holes 412, 414 to couple the lenses 202 and 204 to the planar portion 106.

In some alternative embodiments, the lighting fixture 100 may include a gasket 416 that may be positioned between the housing 102 and the multi-functional heat sink 104 around a perimeter of the housing 102 to prevent water from reaching the section of the planar portion 106 that is covered by the housing 102.

Thus, the multi-functional heat sink 104 can function as a heat sink, a watershed, an optical cutoff, and a service door as described above. Further, because the heat sink 104 can be made from sheet metal (for example, a single piece of aluminum sheet metal) using relatively simple methods such as pressing and bending, manufacturing cost is significantly lower than heat sinks that are made using other methods such as die casting.

Figure 5A:
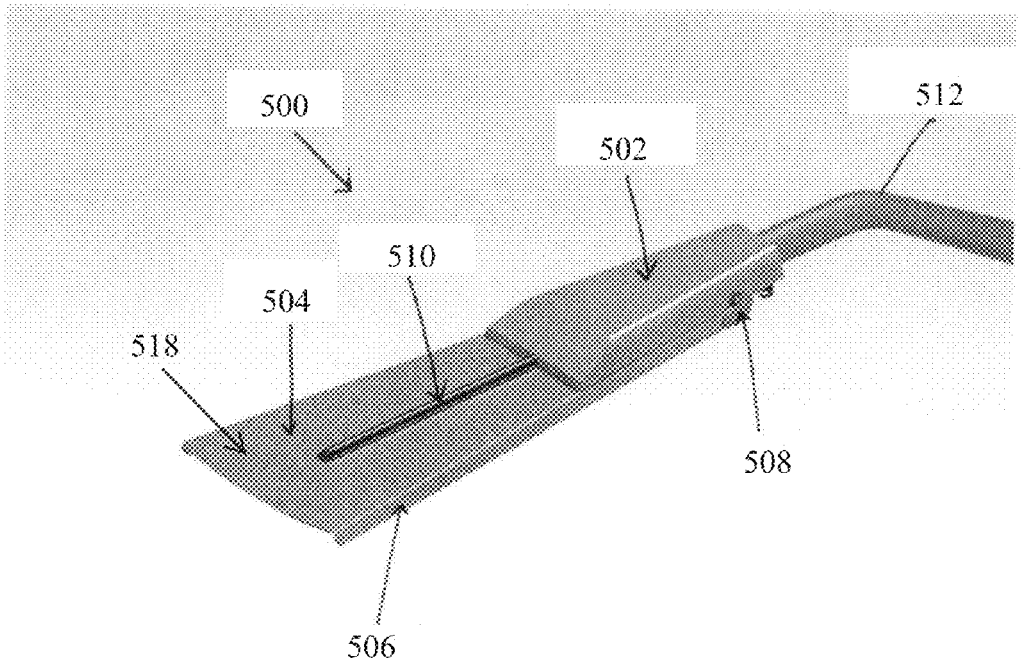
FIGS. 5A and 5B illustrate an outdoor lighting fixture including a multi-functional heat sink according to another example embodiment.
Figure 5B:
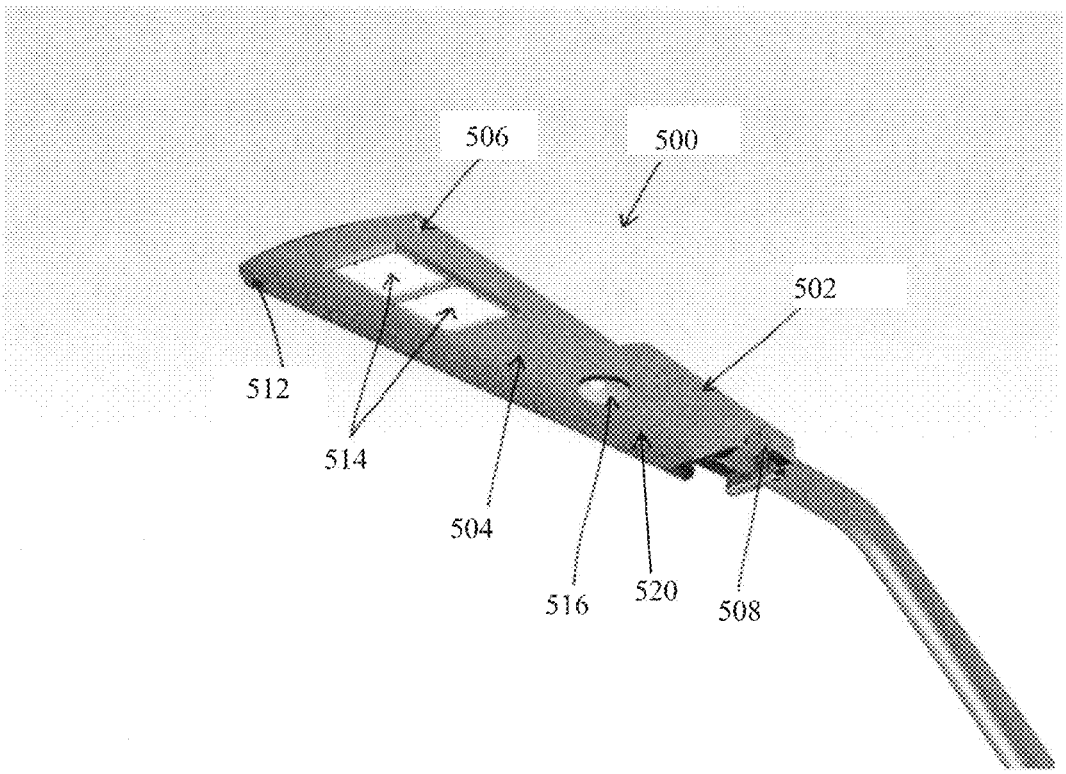

FIGS. 5A and 5B illustrate an outdoor lighting fixture including a multi-functional heat sink according to another example embodiment. The lighting fixture 500 includes a housing 502 and a multi-functional heat sink 504. To illustrate, the housing 502 and the multi-functional heat sink 504 may be attached at one end by a hinge 508 such that the heat sink 504 may be rotatably opened and closed. For example, the hinge 508 may be set in a locked position to keep the multi-functional heat sink 504 in a closed position as illustrated in FIGS. 5A and 5B.

In some example embodiments, the lighting fixture 500 may be attached to a first end of a support beam 512. The lighting fixture 500 also includes one or more light sources 514 (e.g., light emitting diodes) attached to the multi-functional heat sink 504 on an underside 520 of the heat sink 504. The one or more light sources 514 may be covered by one or more lenses. The frame around the one or more light sources 514 and the lenses covering the one or more light sources 514 may help protect the light sources from exposure to environmental conditions.

In some example embodiments, the housing 502 may be disposed on a top side 518 of the heat sink 504 such that the housing 502 covers only a portion of the heat sink 504. For example, a first section of the heat sink 504 may be covered by the housing 502 as shown in FIGS. 5A and 5B, and a second section of the heat sink 504 may be exposed outside of the housing 502. Because the second portion of the heat sink 504 is outside of the housing 502, the second portion of the heat sink 504, which is distal from the hinge 508 and above the light sources 514, may effectively dissipate heat generated by the light sources 514 and other electrical components. For example, the second portion of the heat sink 504, which is exposed to the environment, may have a larger area than the first portion of the heat sink 504 and thus may more efficiently dissipate heat, for example, from the light sources 514 as compared to the same size heat sink that has a relatively large portion that is covered by a housing.

In some example embodiments, the lighting fixture 500 includes a wire cover 510 that protects one or more wires that extend from inside the housing 502 to the lighting sources 514. For example, the wire cover 510 may be made from plastic, rubber, or another material and may be attached to the outside surface of the multi-functional heat sink 504 as illustrated in FIG. 5A. The lighting fixture 500 may further include a sensor lens 516 for a sensor 604 illustrated in FIG. 6. The light sources 514 of the lighting fixture 100 may be turned on or off based on the indication from the sensor 516.

In some example embodiments, the multi-functional heat sink 504 includes a first skirt 506 and a second skirt 512 on opposite longitudinal sides of the multi-functional heat sink 504. The first skirt 506 and the second skirt 512 may limit/prevent light from the light sources 514 from exiting the lighting fixture 500 in an upward direction, which reduces sky-glow due to the light sources 514. Further, because the light sources 514 are positioned on the underside surface of the multi-functional heat sink 504, the multi-functional heat sink 504 functions as a watershed to reduce risk of water damage to the lighting fixture 500, for example, due to electrical short circuit.

Figure 5C:
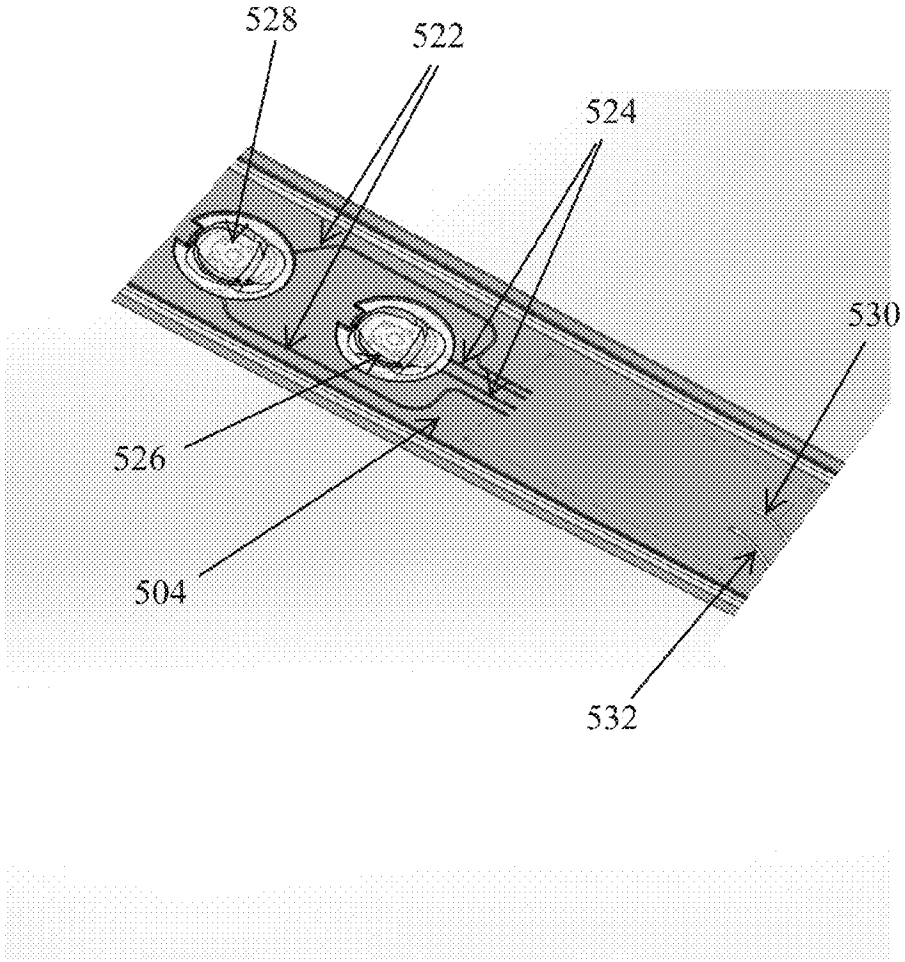
FIGS. 5C and 5D illustrate partial views of the outdoor lighting fixture of FIGS. 5A and 5B according to another example embodiment.
Figure 5D:
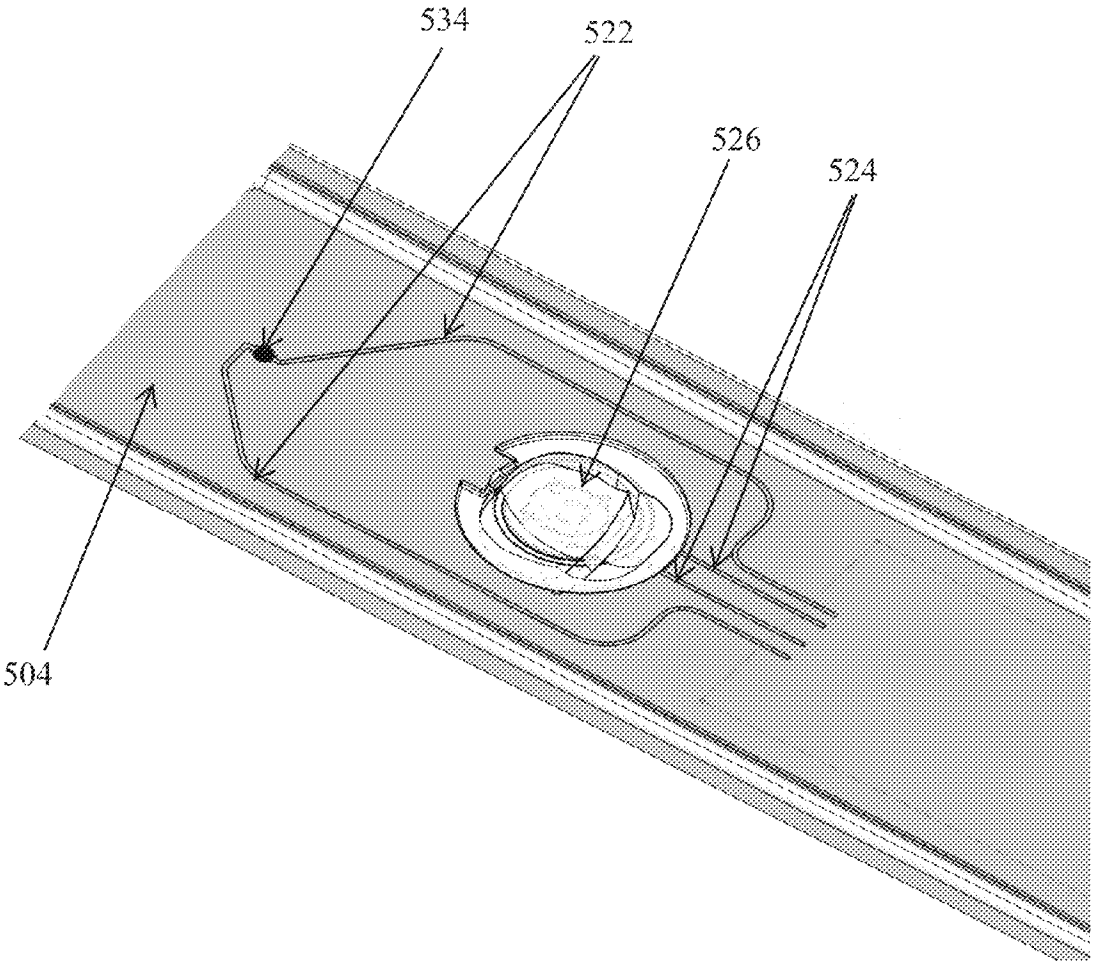

FIGS. 5C and 5D illustrate partial views of the outdoor lighting fixture of FIGS. 5A and 5B according to another example embodiment. As illustrated in FIGS. 5C and 5D, wires traces 522, 524 are routed on the multi-functional heat sink 504 to the light sources 526, 528. For example, the wires traces 522, 524 may be used instead of wires that are covered by the wire cover 510 shown in FIG. 5A. To illustrate, an insulator may first be printed onto to the heat sink 504, and the wire traces 522, 524, which are electrically conductive, may be printed onto the insulator such that the wire traces 522, 524 are electrically isolated from the multi-functional heat sink 504. For example, lines of an electrically insulator material may first be printed on the multi-functional heat sink 504 along the routes of the wire traces 522, 524 shown in FIGS. 5C and 5D. The wire traces 522, 524 may then be printed onto the printed lines of the electrically insulated material. Alternatively, in embodiments where the multi-functional heat sink 504 is made from an electrically insulator material, the wire traces 522, 524 may be directly printed onto the multi-functional heat sink 504.

As shown in FIG. 5C, the wire traces 522 may be routed to the light source 528, and the wire traces 524 may be routed to the light source 526. For example, the wire traces 522 may be connected to an LED 534 as more clearly shown in FIG. 5D.

In some example embodiments, the wire traces 522, 524 may be connected to electrical wires 530, 532. To illustrate, the electrical wires 530, 532 may be connected to a power source, such as a DC source (e.g., an LED driver) or an AC source. The power source may provide power to the light sources 526, 528 via the electrical wires 530, 532 and the corresponding traces 522, 524.

In some example embodiments, the electrical wires 530, 532 may be connected to an electrical driver (e.g., an LED driver) on the top side of the multi-functional heat sink 504. To illustrate, the electrical driver may be the electrical components 606 (shown in FIG. 6), or another component that is positioned, for example, away from the light sources 526, 528. For example, the wire traces 522, 524 may be connected to the electrical driver, for example, by soldering each wire trace 522, 524 to a corresponding wire connected to the electrical driver.

Although the electrical wires 530, 532 are shown in FIG. 5C on the underside of the multi-functional heat sink 504, in alternative embodiments, the electrical wires 530, 532 may be on the top side of the multi-functional heat sink 504.

Figure 6:
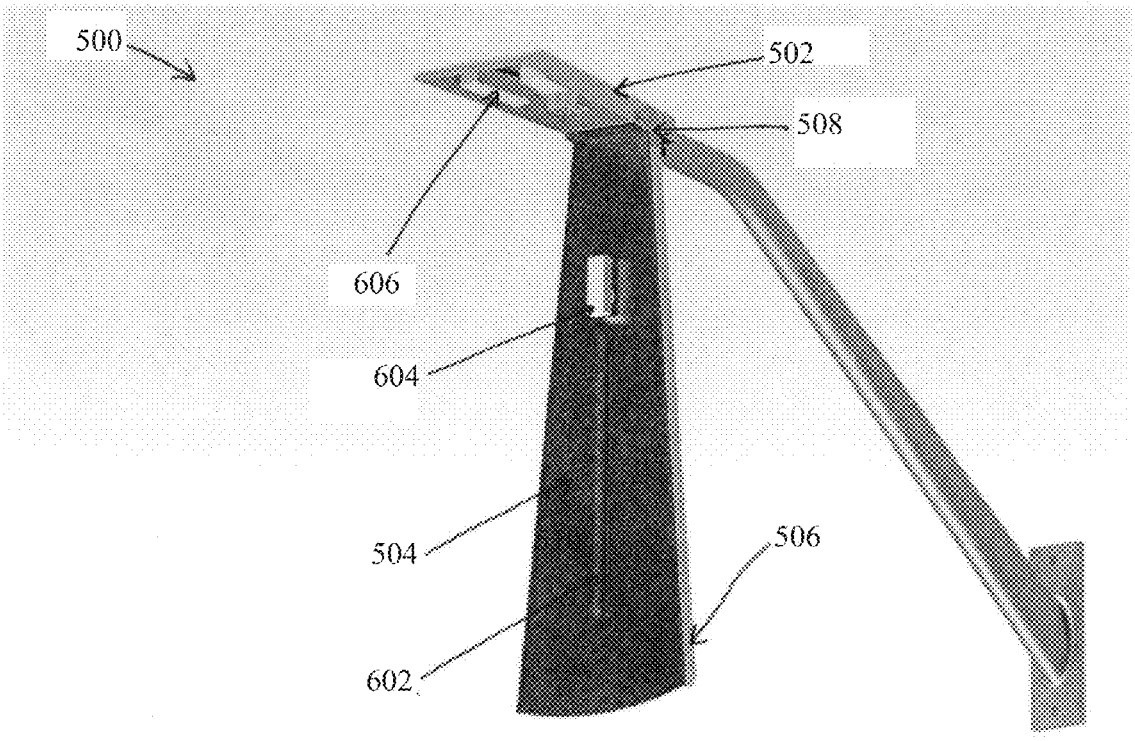
FIG. 6 illustrates the outdoor lighting fixture of FIGS. 5A and 5B with the multi-functional heat sink in an open position according to another example embodiment.

FIG. 6 illustrates the outdoor lighting fixture 500 with the multi-functional heat sink 504 in an open position according to another example embodiment. The multi-functional heat sink 504 is rotated about the hinge 508 to the open position. As illustrated in FIG. 6, one or more electrical components (e.g., a driver that provides power to the light sources 514 shown in FIG. 5B) 606 may be positioned within the housing 502. Further, the sensor 604 (e.g., a motion sensor), which is positioned on the surface of the multi-functional heat sink 504, is housed in the housing 502 when the multi-functional heat sink 504 is in the closed position illustrated in FIGS. 5A and 5B. In some example embodiments, the multi-functional heat sink 504 also includes a wireway 602 impressed into the multi-functional heat sink 504 for the wires to be routed from, for example, the one or more electrical components 606 positioned within the housing 502. In alternative embodiments such as shown in FIGS. 5C and 5D, the wireway 602 may be omitted. The multi-functional heat sink 504 can be made from sheet metal such as aluminum sheet metal (e.g., heavy gauge aluminum sheet metal), which has the benefit of being less expensive and more thermally conductive than die-cast or extruded aluminum.

Figure 7:
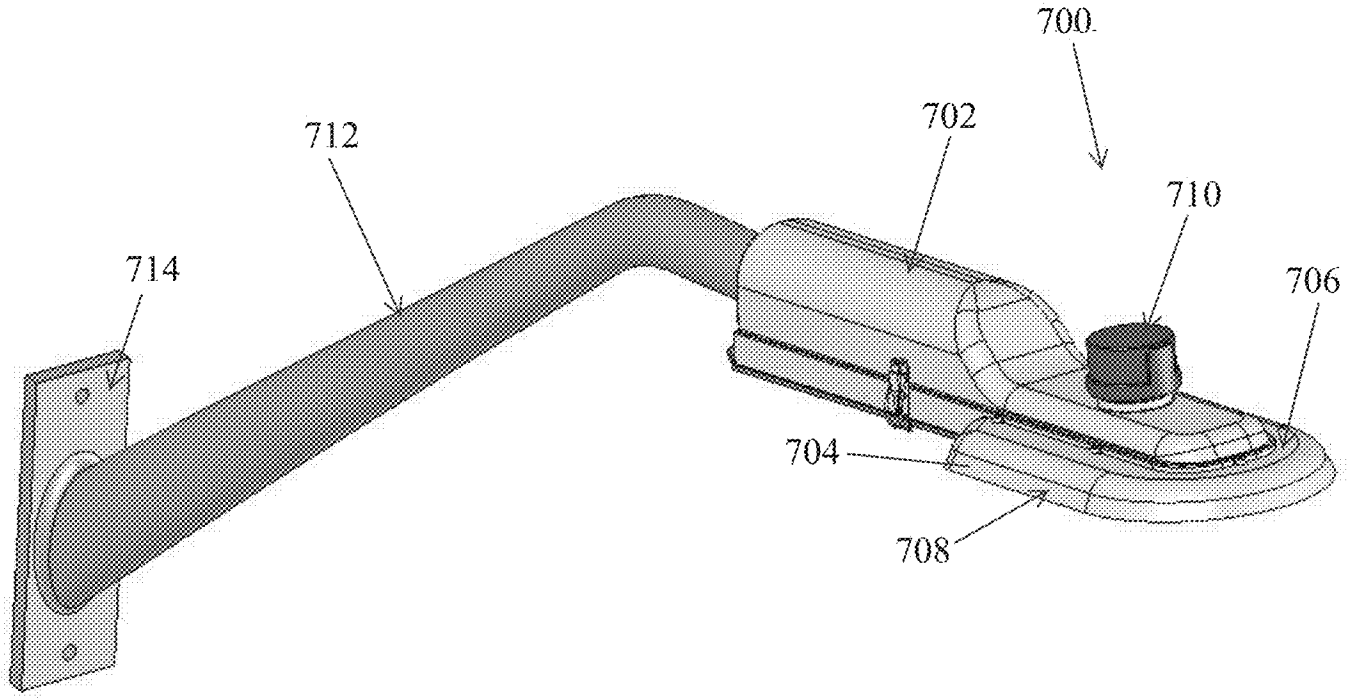
FIG. 7 illustrates an outdoor lighting fixture including a multi-functional heat sink according to another example embodiment.

FIG. 7 illustrates an outdoor lighting fixture including a multi-functional heat sink according to another example embodiment. The lighting fixture 700 includes a housing 702 and a multi-functional heat sink 704. In some example embodiments, the lighting fixture 700 may be attached to a first end of a support beam 712 that includes an attachment plate 714 at a second end of the support beam 712. The lighting fixture 700 also includes an optional sensor 710 that is positioned on the housing 702. For example, the sensor 710 may be a light sensor that senses the presence of adequate light and provides a corresponding indicator or electrical signal. The light sources of the lighting fixture 700 may be turned on or off based on the indicator or electrical signal from the sensor 710.

As illustrated in FIG. 7, the multi-functional heat sink 704 is attached to a bottom portion of the housing 702. For example, the multi-functional heat sink 704 may be removably or rotatably attached to the housing 702. In some example embodiments, the multi-functional heat sink 704 has a top portion 706 and a skirt portion 708. The skirt portion 708 extends down from the top portion 706. For example, the skirt portion 708 may extend down from the outer perimeter of the top portion 706 on all sides of the multi-functional heat sink 704.

The multi-functional heat sink 704 is designed to dissipate heat from light sources and other electrical components of the lighting fixture 700. As illustrated in FIGS. 2 and 3, the lighting fixture 700 includes light sources (e.g., light emitting diodes (LEDs)) that are attached to the multi-functional heat sink 704. For example, the light sources may be disposed on a printed circuit board (PCB) that is coupled to an inside surface of the multi-functional heat sink 704. The multi-functional heat sink 704 may be made from sheet metal, such as aluminum sheet metal, that is an effective heat conductor. Heat generated, for example, by the light sources may be transferred to the multi-functional heat sink 704 from the light sources and effectively dissipated by the multi-functional heat sink 704. Further, because the skirt 708 and sections of the top portion 706 of the multi-functional heat sink 704 are exposed to outside air, heat from the light sources and from other electrical components of the lighting fixture 700 may be effectively dissipated by the multi-functional heat sink 704 into the surrounding environment.

Figure 8:
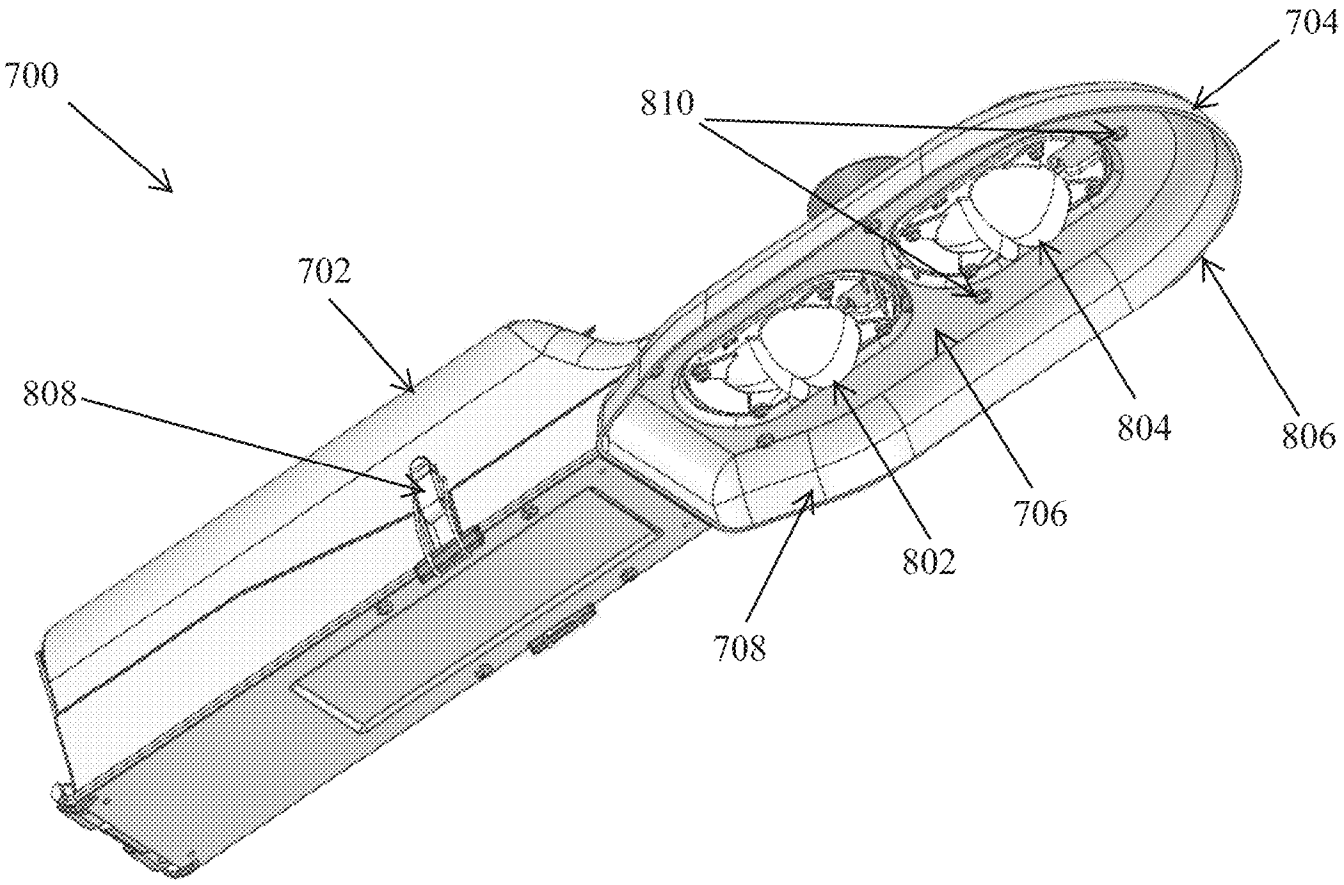
FIG. 8 illustrates a bottom view of the lighting fixture of FIG. 7 according to an example embodiment.
Figure 9A:
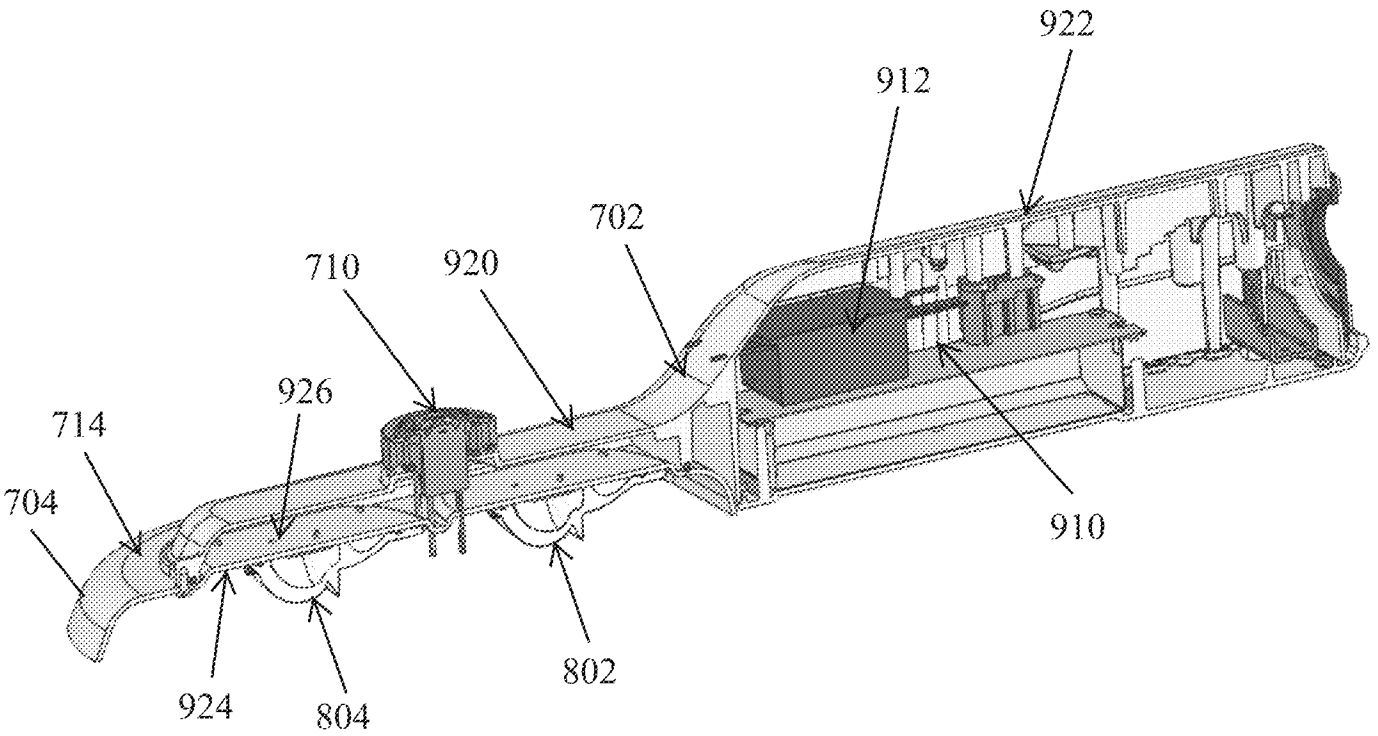
FIGS. 9A and 9B illustrate cross-sectional views of the lighting fixture of FIG. 7 according to an example embodiment.
Figure 9B:
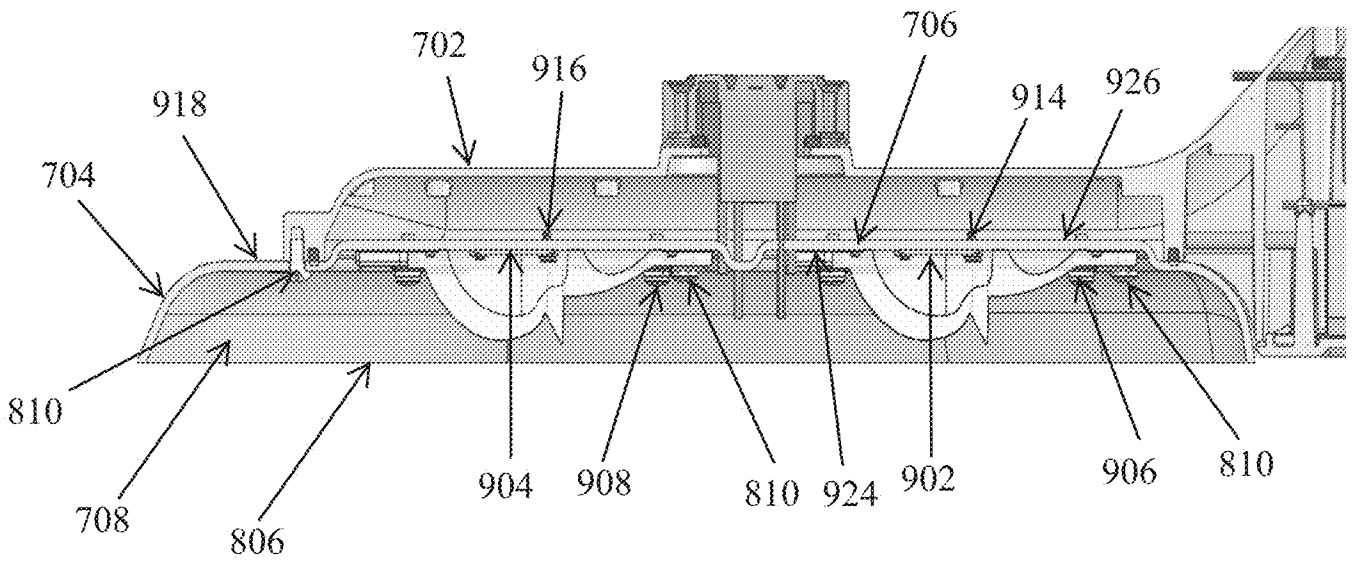

As better illustrated in FIGS. 8, 9A, and 9B, the multi-functional heat sink 704 also functions to protect the light sources from water such as rain water. To illustrate, because the skirt portion 708 extends to a plane below the light sources and the lenses (as more clearly illustrated in FIG. 9B), the skirt portion 708 helps to prevent rain water (e.g., rain falling at slanted angles) from reaching the light sources and the lenses. Further, because the light sources are attached to the inside surface of the top portion 706 of the multi-functional heat sink 704, the top portion 706 also provides protection against the rain. In addition, a significant section of the top portion 706 of the multi-functional heat sink 704 is covered by the housing 702. Because the skirt portion 708 curves down from the outer perimeter of the top portion 706, water that accumulates on the exposed sections of the top portion 706 is provided a convenient path to the ground via the skirt portion 708.

As described below, the multi-functional heat sink 704 further functions as an optical cutoff to reduce sky-glow and glare that may otherwise result from light emitted by the light source of the lighting fixture 700. Further, as described below, the multi-functional heat sink 704 further functions as a service door to enable access to a compartment of the housing 702 that is above the multi-functional heat sink 704. Because the multi-functional heat sink 704 can be made from a single piece of sheet metal, the multi-functional heat sink 704 can be cost effectively manufactured to function as a heat sink, a watershed, an optical cutoff, and a service door. Further, because of improved efficiency of light sources such as LEDs, the multi-functional heat sink 704 can be made from sheet metal without requiring protrusions, such as fins, or other structures used in traditional die cast or extruded heat sinks. For example, the multi-functional heat sink 704 can be made from aluminum sheet metal (e.g., heavy gauge aluminum sheet metal), which has the benefit of being less expensive and more thermally conductive than die-cast or extruded aluminum.

FIG. 8 illustrates a bottom view of the lighting fixture of FIG. 7 according to an example embodiment. As illustrated in FIG. 8, the lighting fixture 700 includes the housing 702 and multi-functional heat sink 704. The multi-functional heat sink 704 is removably or rotatably attached to the housing 702. For example, the multi-functional heat sink 704 may be removably attached to the housing 702 using one or more fasteners 810. The multi-functional heat sink 704 may also be rotatably attached to the housing 708, for example, using one or more hinges.

In some example embodiments, the lighting fixture 700 also includes a first lens 802 and a second lens 804. The first lens 802 and the second lens 804 are attached to the top portion 706 of the multi-functional heat sink 704 on the underside of the multi-functional heat sink 704. The first lens 802 covers one or more light sources (e.g., one or more light emitting diodes (LEDs) disposed on a printed circuit board (PCB)) that are attached to the inside surface of the top portion 706. Similarly, the second lens 804 covers one or more light sources that are attached to the inside surface of the top portion 706. As described above, the multi-functional heat sink 704 dissipates heat from the light sources that are covered by the lenses 802, 804 on the underside of the multi-functional heat sink 704.

In some example embodiments, the multi-functional heat sink 704 further functions as a watershed that protects the light sources and related electrical components from water, such as rain water, that may cause damage (for example, due to a short circuit) to the lighting fixture 700. To illustrate, when the lighting fixture 700 is positioned parallel to a horizontal surface (e.g., ground or floor below the lighting fixture 700, the skirt portion 708 extends down from the top portion 706 to a plane that is below the lenses 802, 804. Thus, the top portion 706 and the skirt portion 708 substantially can prevent rain water (even from slanted rain) from directly reaching the lenses 802, 804. Further, water that accumulates on exposed sections of the top portion 706 can conveniently roll down the curved surface of the skirt portion 708 toward the ground.

In some example embodiments, the multi-functional heat sink 704 further functions as an optical cutoff to reduce sky-glow and glare that may result from light emitted by light sources of the lighting fixture 700. To illustrate, the skirt portion 708 may prevent light from the light sources from exiting the multi-functional heat sink 704 (and thus, the lighting fixture 700) in horizontal and upward directions relative to a lower edge 806 of the skirt portion 708. To illustrate, because the lenses 802 and 804 cover respective light sources, light from the light sources is emitted through the lenses 802 and 804. For example, to reduce sky-glow and glare, the lighting fixture 700 may be positioned such that the lower edge 806 of the skirt portion 708 is below the first lens 802 and the second lens 804 on all sides of the lighting fixture 700. Thus, light emitted by the light sources of the lighting fixture 700 exits from under the multi-functional heat sink 704 in directions that are below an imaginary horizontal plane that includes the lower edge 806 of the skirt portion 708. By limiting the exit path of the light emitted by the light sources to be below the lower edge 806, sky-glow and glare from the lighting fixture 700 are reduced.

In some example embodiments, the housing 702 also includes a latch 808. The latch 808 may be used to hold upper and lower portions of the housing 702 and may be unlatched to gain access to a compartment of the housing 102. In some alternative embodiments, the latch 124 may be omitted or may be replaced by another structure(s) that performs the same or similar function.

FIGS. 9A and 9B illustrate cross-sectional views of the lighting fixture of FIG. 7 according to an example embodiment. As illustrated in FIGS. 9A and 9B, a first light source (e.g., an LED) 902 and a second light source (e.g., an LED) 904 are attached to the top portion 706 of the multi-functional heat sink 704. For example, the first light source 902 may be disposed on a PCB that is attached to the top portion 706. Similarly, the second light source 904 may be disposed on another PCB that is attached to the top portion 706. While the light sources 902, 904 attached to sections of the top portion 706 are shown as elevated above other sections of the top portion 706, in alternative embodiments (for example, similar to the example embodiment of FIG. 4), all sections of the top portion 706 may be substantially in the same plane.

As illustrated in FIGS. 9A and 9B, the first lens 802 is positioned over the first light source 902, and the second lens 804 is positioned over the second light source 904. The first lens 802 and the second lens 804 are attached to the top portion 706 of the multi-functional heat sink 704 on the underside 924 of the multi-functional heat sink 704. The light source 902 may be attached to the top portion 704 by one or more fasteners 914. Similarly, the light source 904 may be attached to the top portion 704 by one or more fasteners 916. Light emitted by the first light source 902 passes through the first lens 802 to illuminate an area below the lighting fixture 700. Similarly, light emitted by the second light source passes through the second lens 804 to illuminate an area below the lighting fixture 700. The first lens 802 may be attached to the top portion 706 of the multi-functional heat sink 704 using one or more fasteners (e.g., screws, snaps, etc.) 906 that extend through one or more corresponding fastener holes in the top portion 706. Similarly, the second lens 804 may be attached to the top portion 706 of the multi-functional heat sink 704 using one or more fasteners 908 that extend through one or more corresponding fastener holes in the top portion 706.

In some example embodiments, the housing 702 may include a compartment 910. For example, the compartment 910 may be positioned in a section of the housing 702 that is not directly above the heat sink 704. To illustrate, the housing 702 may include a front section 920 and a back section 922. For example, the front section 920 may be directly above the heat sink 704, and the compartment 910 may be within the back section 922 of the housing 702. As illustrated in FIGS. 9A and 9B, the front section 920 of the housing 702 may be disposed on the top side 926 of the heat sink 704.

In some example embodiments, a driver (e.g., an LED driver) 912 may be positioned within the compartment 910. The driver 912 is designed to provide power to the light sources 902, 904. For example, wires coupled to the driver 912 may be extended to the light sources 902, 904 through the wire holes in a section the top portion 706 that is covered by the front section 920 of the housing 706. Heat from the driver 912 may be transferred to the housing 702 via contact points between the driver 912 and the housing 702.

As illustrated in FIGS. 7, 9A and 9B, some portions of the top portion 706 are covered by the housing 702 while other portions, such as an exposed portion 918 of the top portion 706, are outside the housing 702. To illustrate, the exposed section 918 may include portions of the top portion 706 on the opposite longitudinal sides of the heat sink and at the front side of the heat sink distal from the compartment 910. Further, the skirt portion 708 is not covered by the housing 702. Thus, the exposed section 918 and the skirt portion 708 can effectively dissipate heat transferred to the multi-functional heat sink 704 from the light sources 902, 904 and other electrical components that transfer heat to the heat sink 104. As described above, the multi-functional heat sink 704 may be made from sheet metal, such as aluminum sheet metal, that is an effective heat conductor.

Further, as more clearly illustrated in FIG. 9B, the lighting fixture 700 may be positioned such that the lower edge 806 of the skirt portion 708 may be below the lowest end of the lenses 802, 804. Because the light sources 902, 904 are positioned in the inside surface of the top portion 706 surrounded by the skirt portion 708 on multiple sides, the multi-functional heat sink 704 functions as a watershed to reduce risk of water damage to the lighting fixture 700, for example, due to electrical short circuiting. Further, because the lower edge 806 of the skirt portion 708 is below the lenses 802 and 804, light from the light sources 902, 904 is prevented from exiting the lighting fixture 700 above the lower edge 806. Thus, the multi-functional heat sink 704 also functions as an optical cutoff that reduces sky-glow and glare from the light sources 902, 904 of the lighting fixture 700.

Figure 10:
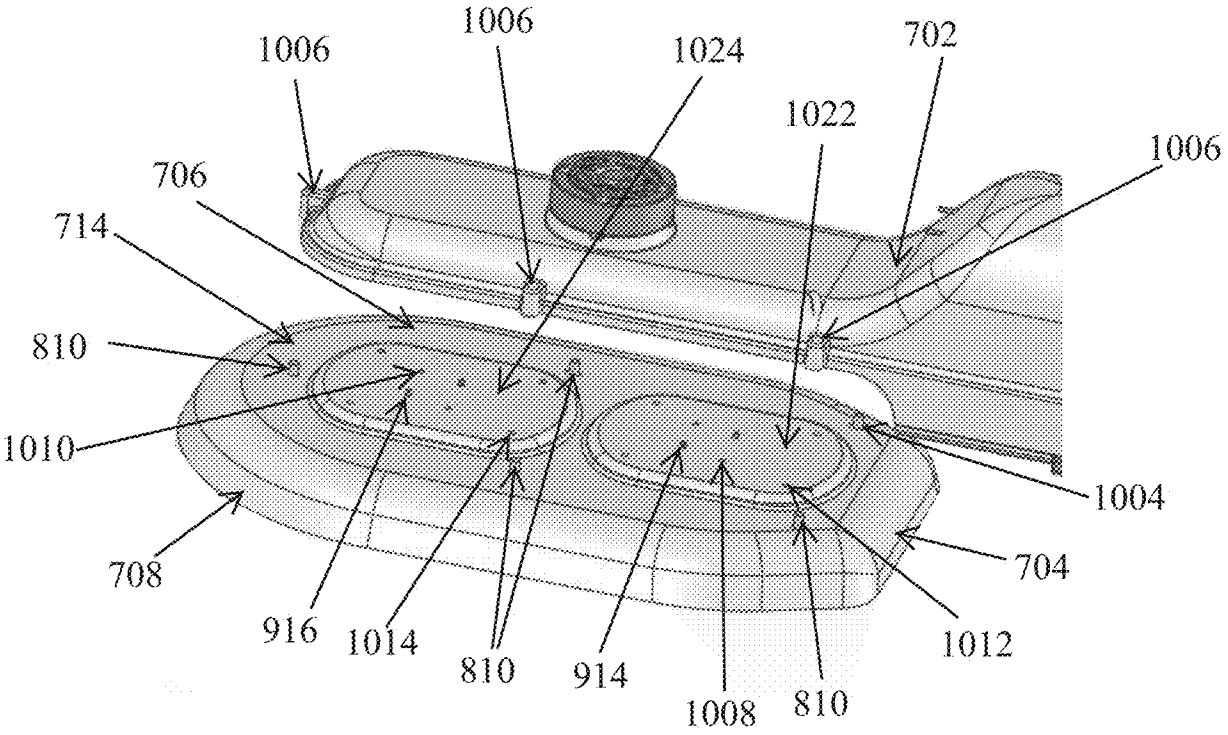
FIG. 10 illustrates a partially-exploded view of the lighting fixture of FIG. 7 according to an example embodiment.

FIG. 10 illustrates a partially-exploded view of the lighting fixture of FIG. 7 according to an example embodiment. As illustrated in FIG. 10, in some example embodiments, the multi-functional heat sink 704 may be removably attached to the housing 702 using the fasteners 810 (e.g., screws). For example, the fasteners 810 may be inserted through corresponding fastener holes 1004 in the multi-functional heat sink 704 and attach to corresponding attachment holes 1006 in the housing 702. Alternatively or in addition, the multi-functional heat sink 704 may be rotatably attached to the housing 702 using one or more hinges (not shown) attached, for example, to a section (e.g., rear section) of the skirt portion 708. Because the multi-functional heat sink 704 is removable, the multi-functional heat sink 704 functions as a service door to provide access to, for example, an area that is behind the heat sink 704 and enclosed by the housing 702. For example, such an area that is behind the heat sink 704 and enclosed by the housing 704 may include electrical connections.

In some example embodiments, electrical wires (not shown) from the driver 912 (shown in FIG. 9A) may be extended through wire holes 1008, 1010 to be coupled to the light sources 902, 904, respectively, shown in FIG. 9B. Fasteners 906, 908 (shown in FIG. 9B) may be inserted in corresponding one or more fastener holes 1012, 1014 to couple the lenses 802, 804 to the top portion 706.

In some example embodiments, the top portion 706 includes elevated portions 1022, 1024. For example, the one or more wire holes 1008 and the one or more fastener holes 1012 may be formed in the elevated portion 1022. Similarly, the one or more wire holes 1010 and the one or more fastener holes 1014 may be formed in the elevated portion 1024. In some example embodiments, the elevated portions 1022, 1024 may be omitted. Alternatively, the top portion 706 may include only one elevated portion or more than two elevated portions.

Thus, the multi-functional heat sink 704 can function as a heat sink, a watershed, an optical cutoff, and a service door as described above. Further, because the heat sink 704 can be made from sheet metal (for example, a single piece of aluminum sheet metal) using relatively simple methods such as pressing and bending, manufacturing cost is significantly lower than heat sinks that are made using other methods such as die casting.

Although particular embodiments have been described herein in detail, the descriptions are by way of example. The features of the example embodiments described herein are representative and, in alternative embodiments, certain features, elements, and/or steps may be added or omitted. Additionally, modifications to aspects of the example embodiments described herein may be made by those skilled in the art without departing from the spirit and scope of the following claims, the scope of which are to be accorded the broadest interpretation so as to encompass modifications and equivalent structures.

What is claimed is:

1. An outdoor lighting fixture, comprising:

a housing having a front section and a back section;

a light source; and a multi-functional heat sink that is a single piece structure made from sheet metal, the multi-functional heat sink comprising:

a top portion, wherein the housing is attached to the top portion, wherein the front section of the housing is positioned on a top side of the multi-functional heat sink and covers a first section of the top portion, wherein a second section of the top portion is outside of the housing, and wherein the light source is attached to the top portion at the first section of the top portion on the underside of the multi-functional heat sink; and a skirt portion extending down from the top portion, wherein the skirt portion reduces risk of rain water reaching the light source and prevents light emitted by the light source from exiting the lighting fixture in an upward direction and wherein a lower edge of the skirt portion is offset horizontally away from the top portion.

2. The outdoor lighting fixture of claim 1, wherein the skirt portion curves down from the top portion.

3. The outdoor lighting fixture of claim 1, wherein an exposed section of the top portion includes sections of the top portion on two longitudinal sides of the housing.

4. The outdoor lighting fixture of claim 1, wherein the multi-functional heat sink is removable from the housing to provide access to an area of the housing that is behind the multi-functional heat sink.

5. The outdoor lighting fixture of claim 1, further comprising a lens attached to the top portion on the underside of the multi-functional heat sink, wherein the lens covers the light source.

6. The outdoor lighting fixture of claim 5, wherein the skirt portion extends around a perimeter of the top portion to a plane that is below the lens to prevent light from the light source from exiting the lighting fixture in a horizontal and upward direction.

7. The outdoor lighting fixture of claim 1, wherein the back section includes a compartment for holding a driver that provides power to the light source.

8. The outdoor lighting fixture of claim 7, wherein the back section of the housing extends beyond the heat sink.

* * * * *